US010057948B2

(12) United States Patent
Cho et al.

(10) Patent No.: US 10,057,948 B2
(45) Date of Patent: Aug. 21, 2018

(54) SWITCH BASED LIGHTING CONTROL

(71) Applicants: Nam Chin Cho, Peachtree City, GA (US); Ryan Lamon Cunningham, Fayetteville, GA (US)

(72) Inventors: Nam Chin Cho, Peachtree City, GA (US); Ryan Lamon Cunningham, Fayetteville, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 15/472,873

(22) Filed: Mar. 29, 2017

(65) Prior Publication Data

US 2017/0347415 A1 Nov. 30, 2017

Related U.S. Application Data

(60) Provisional application No. 62/340,971, filed on May 24, 2016.

(51) Int. Cl.
*H05B 41/36* (2006.01)
*H05B 33/08* (2006.01)

(52) U.S. Cl.
CPC ..... *H05B 33/0815* (2013.01); *H05B 33/0845* (2013.01); *H05B 33/0857* (2013.01)

(58) Field of Classification Search
CPC ..... H05B 37/0272; H05B 37/0218; H05B 41/3922; H05B 37/029; H05B 41/28; H05B 41/295; H05B 41/2827; H05B 41/3925; H05B 33/0815; H05B 33/0818; H05B 41/2828; H05B 41/3921; H05B 41/3927; H05B 33/0803; H05B 37/0254; H05B 37/02; Y02B 20/46; Y02B 20/202; F21V 23/0442; G09F 13/26; A61N 5/0618; A61N 2005/0663; A63J 17/00
See application file for complete search history.

(56) References Cited

U.S. PATENT DOCUMENTS

| | | | | |
|---|---|---|---|---|
| 7,190,125 | B2 | 3/2007 | McDonough et al. | |
| 8,294,379 | B2 | 10/2012 | Liu et al. | |
| 8,598,804 | B2 | 12/2013 | Foxall et al. | |
| 8,829,818 | B2 | 9/2014 | Zudrell-Koch et al. | |
| 9,137,878 | B2 * | 9/2015 | Thompson ..... | H05B 37/0227 |
| 9,781,814 | B2 * | 10/2017 | Wagner ..... | H05B 37/0272 |
| 9,894,735 | B2 * | 2/2018 | Keith ..... | H05B 37/0227 |
| 2004/0085030 | A1 | 5/2004 | Laflamme et al. | |

OTHER PUBLICATIONS https://www.youtube.com/watch?v=kNhx4-FmUZs ; Sep. 2, 2016.
PCT Search Report for PCT/US2017/024738 dated Aug. 3, 2017.

* cited by examiner

*Primary Examiner* — Minh D A
(74) *Attorney, Agent, or Firm* — King & Spalding LLP

(57) ABSTRACT

An LED driver includes a controller configured to detect toggles of a switch that controls whether electrical power is provided to the LED driver. The controller is further configured to determine whether a toggle sequence of the switch matches an operation mode sequence. The toggle sequence of the switch includes a sequence of one or more toggles of the toggles of the switch that the controller detects. The controller is also configured to change a setting of the LED driver based on whether the toggle sequence of the switch matches the operation mode sequence.

27 Claims, 9 Drawing Sheets

SWITCH BASED LIGHTING CONTROL

CROSS REFERENCE TO RELATED APPLICATIONS

The present application claims priority under 35 U.S.C. Section 119(e) to U.S. Provisional Patent Application No. 62/340,971, filed May 24, 2016, and titled "Switch Based Lighting Color Adjustment," the entire content of which is incorporated herein by reference.

TECHNICAL FIELD

The present disclosure relates generally to lighting solutions, and more particularly to lighting device control using a light switch.

BACKGROUND

Some lighting fixtures may be controllable to change characteristics (e.g., dim level, correlated color temperature (CCT), etc.) of the light emitted by the lighting fixtures. For example, some lighting devices or fixtures may be dimmable. Typically, a dimmer (e.g., a Triac, 0-10V, etc.) is used adjust the dim level of a light emitted by a dimmable lighting fixture or device. However, dimmable lighting devices (e.g., a dimmable LED light source) and dimmable lighting fixtures are often not connected to a dimmer, and thus, unable to achieve possible better lighting and energy savings. Lighting fixtures that may also be controlled with respect to other characteristics of the lights and fixtures are not fully utilized for lack of control. For example, because of the cost and complexity associated with a separate dimmer or control device for light color or color temperature adjustment, an otherwise controllable lighting fixture/device may be underutilized. Thus, a solution that enables the existing wired lighting infrastructure to be used for control and adjustment of lighting fixtures and devices is desirable.

SUMMARY

The present disclosure relates to lighting device control using a light switch. In an example embodiment, an LED driver includes a controller configured to detect toggles of a switch that controls whether electrical power is provided to the LED driver. The controller is further configured to determine whether a toggle sequence of the switch matches an operation mode sequence. The toggle sequence of the switch includes a sequence of one or more toggles of the detected toggles of the switch. The controller is also configured to change a setting of the LED driver based on whether the toggle sequence of the switch matches the operation mode sequence.

In another example embodiment, a lighting fixture includes a light emitting diode (LED) light source and a driver that provides power to the LED light source, the driver configured to detect toggles of a switch that controls whether electrical power is provided to the light fixture and to determine whether a toggle sequence of the switch matches an operation mode sequence of the lighting fixture. The toggle sequence of the switch comprises a sequence of one or more toggles of the detected toggles of the switch. The driver is also configured to change one or more characteristics of a light emitted by the light source based on whether the toggle sequence of the switch matches the operation mode sequence.

In another example embodiment, a method of controlling operations of a lighting device includes detecting, by an LED driver, toggles of a switch, where the switch controls whether electrical power is provided to the LED driver. The method may further include determining, by the LED driver, whether a toggle sequence of the switch matches an operation mode sequence, where the toggle sequence of the switch comprises a sequence of one or more toggles of the detected toggles of the switch. The method may also include changing a setting of the LED driver based on whether the toggle sequence of the switch matches the operation mode sequence.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
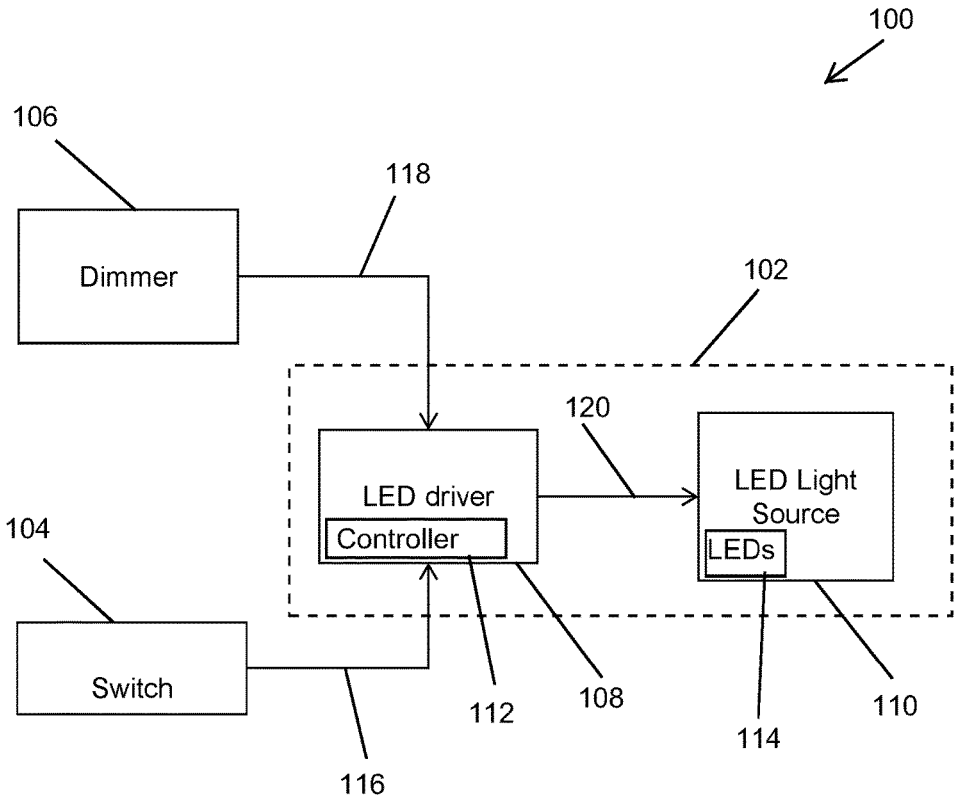
FIG. 1 illustrates a wired lighting system including an LED driver controllable by a light switch according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

In some example embodiments, an on/off light switch (e.g., a wall-mounted toggle switch) can be used to adjust the characteristics of a light emitted by a light source. For example, a switch that controls availability of electrical power to the lighting device may be used to control a lighting mode of a light device or otherwise change settings and/or operational modes of the lighting device. To illustrate, a lighting device may operate in a night light mode or another lighting mode based on a toggle sequence of the switch. As a non-limiting example, a toggle sequence of the switch may include a toggle to on and remaining on for longer time than a threshold time period following a toggle to off within a threshold time period (e.g., within 3 seconds) of a prior toggle to on. The lighting device may save, for example, in a non-volatile memory device (e.g., EPROM) of the lighting device, toggle sequence related information during times that the switch is on and use the information to change settings of the lighting device and/or perform other operations that may change characteristics of a light emitted by a light source. For example, toggle sequence related information may include duration of on-state of the switch (i.e., the length of time that the switch is on), the number of toggles of the switch, etc.

As another non-limiting example, a toggle sequence of a switch may include a toggle to on followed by toggle to off within a threshold time period (e.g., within 3 seconds) repeated a number of times (e.g., twice) and followed by a toggle to on and remaining on for longer than a threshold period of time that may be of the same or longer duration than other thresholds.

In some example embodiments, a lighting device may perform a dim level adjustment process in response to a toggle sequence of a switch, where, for example, the dim level setting of the lighting device is set or changed based on further one or more toggles of the switch with or without constraints on length of the on-state duration of the switch. For example, the dim level adjustment process may be performed to set the maximum and/or the minimum dim brightness level of a light emitted by the lighting device in response to dim level adjustments by a dimmer device.

In some example embodiments, the lighting device may also perform a CCT adjustment process in response to a toggle sequence of a switch, where, for example, the CCT setting of the lighting device is set or changed based on further one or more toggles of the switch with or without constraints on the length of the on-state duration of the switch.

In some example embodiments, other operations may also be performed based on one or more toggle sequences of the switch. For example, the capability to change some settings of the lighting device or to otherwise control some operations of the lighting device may be controlled based on one or more toggle sequences of the switch. As another example, the lighting device may be reset to factory default settings in response to a particular toggle sequence of the switch.

Some or all of the above operations performed in response to toggle sequences of the switch may be performed in a programming mode that is entered into in response to a particular toggle sequence of the switch.

Because the switch controls whether mains power is provided to the lighting device, the lighting device can detect toggles of the switch based on the availability of power to the lighting device. By performing mains power toggle detection, for example, by the LED driver of the lighting fixture, a lighting fixture is able to change characteristics of its light (e.g., dim level, CCT, color, etc.).

Turning now to the figures, example embodiments are described. FIG. 1 illustrates a lighting system 100 including an LED driver 108 controllable by a light switch 104 according to an example embodiment. The lighting system 100 includes a lighting fixture 102 and the light switch 104 (e.g., a toggle switch). The lighting system 100 may also include a dimmer 106.

The switch 104 may be a device that can function as a light switch to turn on and off a lighting fixture. To illustrate, the switch 104 may be a wall-mounted switch that is used to turn on and off the lighting fixture 102. Electrical power is provided to the lighting fixture 102 when the switch 104 is on (i.e., the switch 104 is in on-state), and no electrical power may be available to the lighting fixture 102 when the switch 104 is off (i.e., the switch 104 is in off-state). The switch 104 may be a toggle switch or another kind of switch.

In some example embodiments, the optional dimmer 106 may be a slider dimmer, a rotary dimmer, or another type of dimmer that may be used to change the intensity of light provided by the lighting fixture 102. The dimmer 106 may be a standalone dimmer or a dimmer that is integrated with the switch 104 or with another lighting control device.

In some example embodiments, the lighting fixture 102 of the lighting system 100 may include the LED driver 108 and the LED light source 110. The switch 104 is coupled to the LED driver 108 by an electrical connection 116 (e.g., one or more electrical wires). The optional dimmer 106 is coupled to the LED driver 108 by an electrical connection 118 (e.g., one or more electrical wires). The connections 116, 118 may each be an existing wiring, a new wiring, or a combination thereof.

In some example embodiments, the LED driver 108 may be directly or indirectly coupled to the light source 110 and may provide power to the light source 110. For example, an electrical connection 120 (e.g., one or more electrical wires) may couple the LED driver 108 with the light source 110. The LED driver 108 may provide power to the light source 110 based on the electrical power (e.g., mains power) that is provided to the LED driver 108 through the switch 104 or otherwise controlled by the switch 104.

The LED driver 108 may provide power to the light source 110 when power (e.g., AC mains power) is provided to the driver 108. Further, the LED driver 108 may control the light source 110 to adjust characteristics of the light emitted by the light source 110. For example, the LED driver 108 may change the power provided to the light source 110 to adjust the brightness level (i.e., dim level) of the light emitted by the light source 110. As another example, the LED driver 108 may control the light source 110 to adjust the CCT of the light emitted by the light source 110, for example, by controlling the power provided to different LEDs of the light source 110. To illustrate, the LED light source 110 may include one or more LEDs 114. For example, the LED light source 110 may include discrete LEDs, organic light emitting diodes (OLEDs), an LED chip on board that includes discrete LEDs, or an array of discrete LEDs. The LEDs 114 may include a mix of different LEDs.

In some example embodiments, the LEDs 114 may include some LEDs that emit white light and some LEDs that emit color lights. In addition or alternatively, the LEDs 114 may include LEDs that emit white lights with different with different CCTs. For example, the mix of different LEDs may enable the driver 108 to control the light source 110 to adjust the CCT of the light emitted by the LED light source 110.

In some example embodiments, the LED driver 108 may control the light source 110 based on one or more settings of the driver 108. To illustrate, the characteristics of the light emitted by the light source 110 may depend on values of one or more settings of the driver 108. To illustrate, the CCT of the light may depend on the CCT setting of the LED driver 108, and the dim level of the light may depend on the dim level setting of the LED driver 108. The settings of the driver 108 may be changed to change the respective characteristics of the light.

In some example embodiments, the LED driver 108 includes a controller 112. The controller 112 may operate to control (e.g., adjust) characteristics of the light emitted by the light source 110. The controller 112 may change one or more settings of the LED driver 108 to adjust characteristics of the light.

To illustrate, the controller 112 may operate to adjust one or more characteristics of the light based on input from the switch 104 received by the driver 108 via the connection 116. For example, the controller 112 may adjust the intensity (i.e., brightness or dim level) of the light emitted by the light source 110 based on one or more toggles of the switch 104. As another example, the controller 112 may alternatively or in addition adjust the CCT of the light emitted by the LED light source 110 based on one or more toggles of the switch 104.

In some example embodiments, the lighting fixture 102 may operate in one mode based on a toggle sequence of one or more toggles of the switch 104 and may operate in another mode based on another toggle sequence of one or more toggles of the switch 104. For example, lighting fixture 102 may operate in a night light/presentation mode where the light has a relatively low intensity level (e.g., 10% of the maximum brightness level) if the controller 112 detects a toggle sequence that matches a night light operation mode sequence of the lighting fixture 102.

In some example embodiments, the controller 112 may also control other operations of the lighting fixture 102 based on input from the switch 104 received by the driver 108 via the connection 116. To illustrate, based on a particular toggle sequence of the switch 104, the controller 112 may control whether one or more settings of the LED driver 108 can be changed. For example, based on a toggle sequence of the switch 104 that matches a lock operation mode sequence of the driver 108, the controller 112 may lock the driver 108 such that the dim level setting, the CCT setting, and/or other settings of the driver 108 cannot be changed based on one or more toggles of the switch 104. That is, the controller 112 may put the driver 108 in a locked mode. When the driver 108 is in the locked mode, the controller 112 may unlock the driver 108 based a sequence of one or more toggles of the switch 104 that matches an unlock operation mode sequence of the driver 108. That is, the controller 112 may put the driver 108 in an unlocked mode. As another example, the controller 112 may also reset the driver 108 to factory default settings in response to a sequence of one or more toggles of the switch 104 that matches a reset operation mode.

To illustrate, the controller 112 may detect toggles of the switch 104, for example, based on the power provided to the driver 108. For example, the controller 112 may monitor the mains power signal provided to the driver 108 to determine when the mains power dips below a threshold level that is indicative of a turning off of the switch 104. To illustrate, when the mains power dips below the threshold level, the controller 112 may consider the particular power dip as corresponding to the turning off of the switch 104 and may store indicative information before the mains power becomes unavailable. For example, the controller 112 may store the information in a non-volatile memory device (e.g., an EPROM) that is within or otherwise communicable coupled to the driver 108.

In some example embodiments, the controller 112 may also determine when the power (e.g., the mains power) becomes available to the driver 108 after being unavailable in order to detect a turning on of the switch 104. For example, when the mains power increases above a threshold, the controller 112 may consider the particular increase in the power as corresponding to the turning on of the switch 104 and may store indicative information in the memory device. The controller 112 may also determine duration of the availability of the power provided to the driver 108, for example, between a turning on of the switch 104 and a turning off of the switch 104. The controller 112 may also store duration and other information related to the toggling of the switch 104 and sequences of the toggles of the switch 104 in the memory device. For example, the controller 112 may repeatedly store updated duration information in the memory device during the availability of the power such that, when the power becomes unavailable, the information in the memory device is up to date. In some example embodiments, toggles of the switch 104 may be detected and relevant information may be stored using other means that may be contemplated by those of ordinary skill in the art with the benefit of this disclosure.

In some example embodiments, the controller 112 may determine whether a toggle sequence of the switch 104 matches an operation mode sequence, such as a night light operation mode sequence, a dim level adjustment mode sequence, a CCT adjustment operation mode sequence, a locked operation mode sequence, an unlocked operation mode sequence, etc. The toggle sequence of the switch 104 may be a sequence of one or more toggles of the switch 104 detected by the controller 112, for example, based on the availability of the power provided to the LED driver 108. The controller 112 may change a setting of the LED driver 108 based on whether the toggle sequence of the switch matches a particular operation mode sequence. For example, the controller 112 may change the setting of the driver 108 if the toggle sequence matches a particular operation mode sequence. Alternatively, the controller 112 may change the setting of the driver 108 if the toggle sequence does not match a particular sequence. The setting of the LED driver 108 may include the dim level setting of the driver 108, the CCT setting of the driver 108, the lock/unlock setting of the driver 108 that controls whether the driver 108 operates in the lock/unlock mode, the factory default reset setting of the driver 108 that controls whether the driver 108 is at least partially reset to factory default settings values, another setting of the driver 108 or the lighting fixture 102, or a combination of one or more of these settings. The different operation mode sequences may be hardwired, stored in a non-volatile memory device of the lighting fixture 400 (e.g., a memory device in the driver 108), and/or otherwise provided to the driver 108.

In some example embodiments, a toggle sequence of the switch 104 may include or may depend on duration of time that the switch 104 remains on after being turned/toggled on. For example, a toggle sequence of the switch 104 that matches an operation mode sequence may include the switch 104 being toggled on and remaining on for less than a threshold time (e.g., 3 seconds) after being toggled on.

In some example embodiments, the controller 112 may determine whether a toggle sequence of the switch 104 matches a second operation mode sequence. For example, the controller 112 may determine whether the toggle sequence of the switch 104 matches one operation mode sequence in parallel with the controller 112 determining whether the toggle sequence of the switch 104 matches another operation mode sequence. Alternatively the controller 112 may determine whether a toggle sequence of the switch 104 matches a second operation mode sequence after determining that the toggle sequence of the switch 104 does not match a first operation mode sequence. The controller 112 may change the setting of the LED driver 108 based on whether the toggle sequence of the switch 104 matches the second operation mode sequence. For example, the controller 112 may change a different setting of the driver 108 if the toggle sequence matches the second operation mode sequence. Alternatively, the controller 112 may change a different setting of the driver 108 if the toggle sequence does not match the second operation mode sequence. In general, the controller 112 may determine which one of multiple operation mode sequences matches a toggle sequence of the switch 104 serially or in parallel.

In some example embodiments, the controller 112 may determine whether a particular toggle sequence of one or more toggles of the switch 104 matches a particular operation mode sequence after determining that another toggle sequence of one or more toggles of the switch 104 does not match the particular operation mode sequence and/or another operation mode sequence. For example, after determining that a first toggle sequence of the switch 104 does not match a first operation mode sequence, the controller 112 may determine whether a second toggle sequence of the switch 104 matches a second operation mode sequence, for example, after or in response to detection of one or more toggles of the switch 104. The controller 112 may then change the setting of the LED driver 108 based on whether the second toggle sequence of the switch matches the second operation mode sequence. For example, the controller 112 may change a setting of the driver 108 if the second toggle sequence matches the second operation mode sequence. Alternatively, the controller 112 may change a setting of the driver 108 if the second toggle sequence does not match the second operation mode sequence.

In some example embodiments, the controller 112 determines whether the toggle sequence of the switch 104 matches one or more operation mode sequences in response to the controller 112 determining that a sequence of one or more toggles of the switch 104 matches a programming mode sequence. For example, the controller 112 may enter a programming mode in response to the sequence of one or more toggles of the switch 104 matching the programming mode sequence the programming mode and may change one or more settings of the driver 108 based on whether a sequence of one or more toggles of the switch 104 match an operation mode sequence.

By using the switch 104 for controlling operations of the LED driver 108, capabilities of the LED driver 108 may be more efficiently utilized to control operations of the lighting fixture 102 including controlling characteristics (e.g., dim level, CCT, etc.) of the light emitted by the light source 110. Use of the switch 104 to control the lighting fixture 102 turning on and off the light provided by the lighting fixture 102 can save cost and time that can be associated with installing a different lighting fixture that, for example, requires a more complex control device. Because the switch 104 and the wiring between the switch 104 and the lighting fixture 102 may be existing switch and wiring, installation cost and time may be saved. Further, by using the switch 104, a need for a wirelessly controlled driver and/or lighting fixture may be avoided.

Although the LED driver 108 is shown as part of the lighting fixture 102, in some example embodiments, the LED driver 108 may be outside of the lighting fixture 102 without departing from the scope of this disclosure. In some example embodiments, the LED driver 108 may be on the same circuit board, a mating circuit board, or integrated with the LED light source 110. For example, a lighting device may include the driver 108 and the light source 110 and may be controlled by the switch 104 as described above. Although the lighting system 100 is described with respect to the LED driver 108 and the LED light source 110, in some alternative embodiments, the lighting system 100 may include non-LED driver and non-LED light source without departing from the scope of this disclosure.

Figure 2:
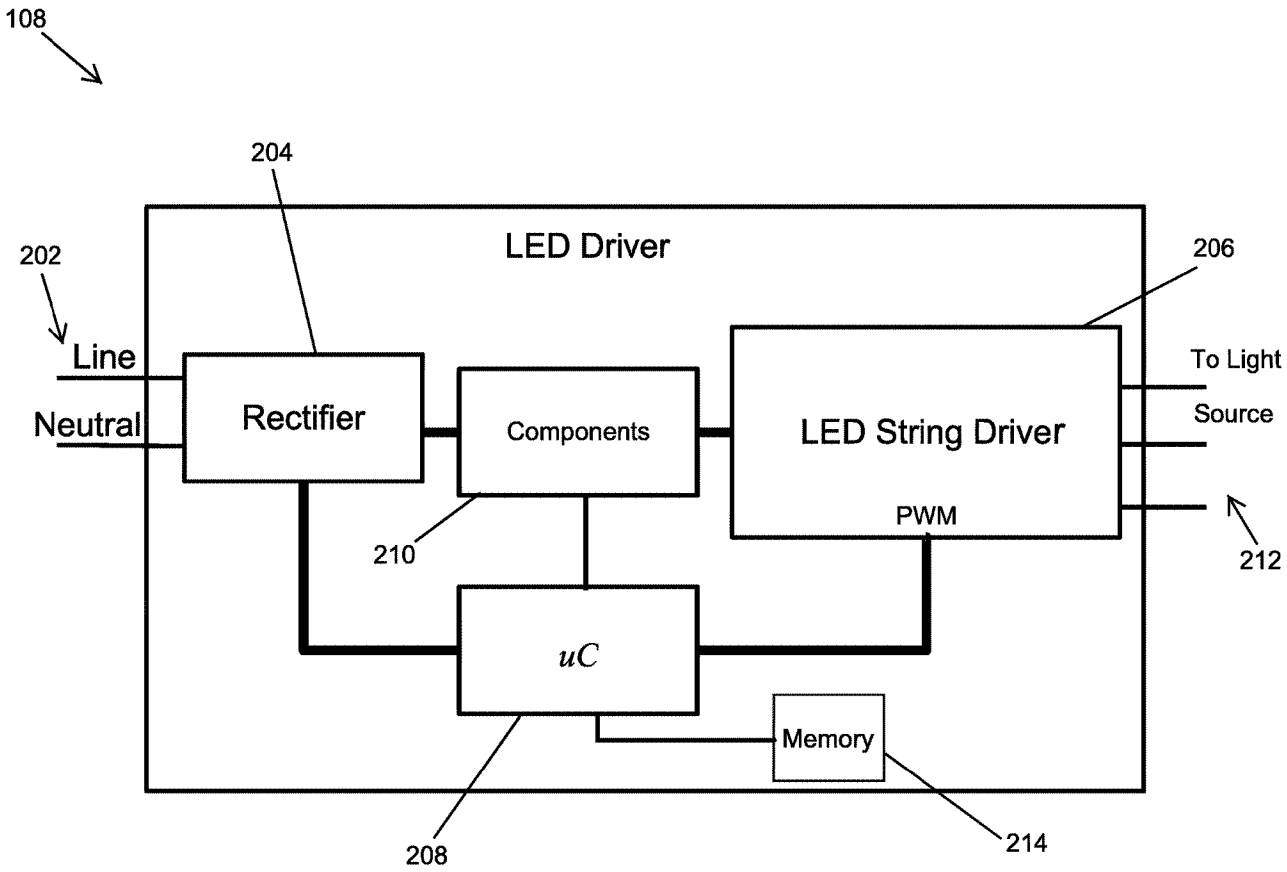
FIG. 2 illustrates the LED driver of FIG. 1 according to an example embodiment.

FIG. 2 illustrates the LED driver 108 of FIG. 1 according to an example embodiment. Referring to FIGS. 1 and 2, in some example embodiments, the LED driver 108 includes a rectifier circuit 204, an LED string driver circuit 206, and a driver controller 208. The driver 108 may also include other driver components 210 and a non-volatile memory device 214.

In some example embodiments, the LED driver 108 includes an Alternating Current (AC) input connection 202 (Line and Neutral) to receive an AC power signal from a power source such as mains power source. The AC power may be provided to the driver 108, for example, through the switch 104. Alternatively, the switch 104 may control the availability of the AC power to the driver 108 without the AC power signal being provided to the driver 108 through the switch 104. The driver 108 may also include output connection 212 that is used to provide power to a light source, such as the LED light source 110.

In some example embodiments, the driver controller 208 may correspond to the controller 112 of FIG. 1, or the controller 112 may include the driver controller 208, the non-volatile memory device 214, and/or other components such as an analog to digital converter. The controller 208 may be a microcontroller or may include a microcontroller.

In some example embodiments, the rectifier circuit 204 is coupled to the AC input connection 202 and receives and rectifies the AC power signal to generate a rectified signal. The rectifier circuit 204 may be implemented in one of several ways known to those of ordinary skill in the art. The rectified output signal from the rectifier circuit 204 is provided to the driver controller 208.

Based on the rectified signal from the rectifier circuit 204, the controller 208 may detect the toggles of the switch 104, for example, as described above with respect to FIG. 1. The controller 208 may also determine duration to time that the switch 104 is on based on the rectified signal. The controller 208 may store information such as number of toggles, duration on on-state of the switch 104 (i.e., duration of availability of power), and other information related to toggle sequences of the toggles of the switch 104 in the memory device 214.

In some example embodiments, the memory device 214 may include software code that is executable by the controller 208 to perform operations such as detecting toggles of the switch 104, identifying/determining toggle sequences, determining whether a toggle sequence matches an operation mode sequence, etc. The memory device 214 may also include settings of the driver 108 such as dim level setting, CCT setting, etc. For example, the controller 208 may update the driver settings stored in the memory device 214 based on the toggle sequences of the switch 104. The memory device 214 may also contain operation mode sequences such as night light mode sequence, dim level adjustment mode sequence, etc. In some alternative embodiments, the software code and/or other information may be stored in another memory device without departing from the scope of this disclosure.

The controller 208 may use the information stored in the memory device 214 when the power is available. For example, when power becomes available (i.e., when the switch 104 is turned on after being turned off), the controller 208 may use the information stored in the memory device 214 prior to the switch 104 being turned off to identify/determine a toggle sequence of the toggles of the switch 104 and determine whether the toggle sequence matches a particular operation mode sequence. For example, the controller 208 may increment counts, monitor time periods, etc. and store the information in the memory device 214 when power is available and up to a point when the power is turned off, and when the power comes back on, the controller 208 may use the information to perform comparison, change settings, etc.

As illustrated in FIG. 2, the controller 208 is coupled to the LED string drive circuit 206. The controller 208 may control the LED string driver circuit 206 to adjust characteristics of the light emitted by the light source 110. For example, the controller 208 may control the LED string driver circuit 206 based on the settings of the driver 108 that may be changed depending on the toggle sequences of the switch 104 as described above.

In some example embodiments, the controller 208 may provide a pulse width modulation (PWM) signal to the drive circuit 206 to control the output of the drive circuit 206. The drive circuit 206 may adjust the output signal(s) provided at the output connection 212 to adjust the characteristics of the light emitted by the light source 110 based on the PWM signal from the controller 208. The output connection 212 may include multiple connections that are coupled to different strings of LEDs of the light source 110. For example, the drive circuit 206 may change the power on one or more of the different connections to change one or more characteristics of the light emitted by the light source 110. In some alternative embodiments, the drive circuit 206 may control different strings of LEDs of the light source 110 in a different manner as may be contemplated by those of ordinary skill in the art with the benefit of this disclosure to adjust characteristics of the light. The drive circuit 206 may be implemented in one of several means that can be readily contemplated by those of ordinary skill in the art with the benefit of this disclosure. In some alternative embodiments, the controller 208 may control the drive circuit 206 based on output signal(s) other than or in addition to PWM signal(s).

In some example embodiments, the rectified output signal may be provided to the component 210, which may include additional components used in implementing the driver 108. For example, the component 210 may include circuitry to implement phase-cut dimming as can be understood by those of ordinary skill in the art with the benefit of this disclosure. The driver components 210 may also include other circuit components, such as capacitors. For example, one or more capacitors may be used to store power that can be used by the controller 208, for example, to detect toggling/turning off of the switch 104 based on the availability of power at the input connection 202 or the output of the rectifier circuit 204. In some example embodiments, the driver 108 may include one or more capacitors with that have the capacitance to store adequate power for the controller 208 to execute a number of operations (e.g., store toggle information, duration of on-state of the switch 104, etc.) after switch 104 is toggled/turned off.

In some example embodiments, the controller 208 may be implemented in hardware, software, or a combination thereof. Although particular components and connections between the components are shown in FIG. 2, in alternative embodiments, the driver 108 may include other components and connections without departing from the scope of this disclosure. In some alternative embodiments, some of the components of the driver 108 may be integrated into a single component. Further, the driver 108 may be implemented using components in addition to or other than shown in FIG. 2 without departing from the scope of this disclosure.

Figure 3:
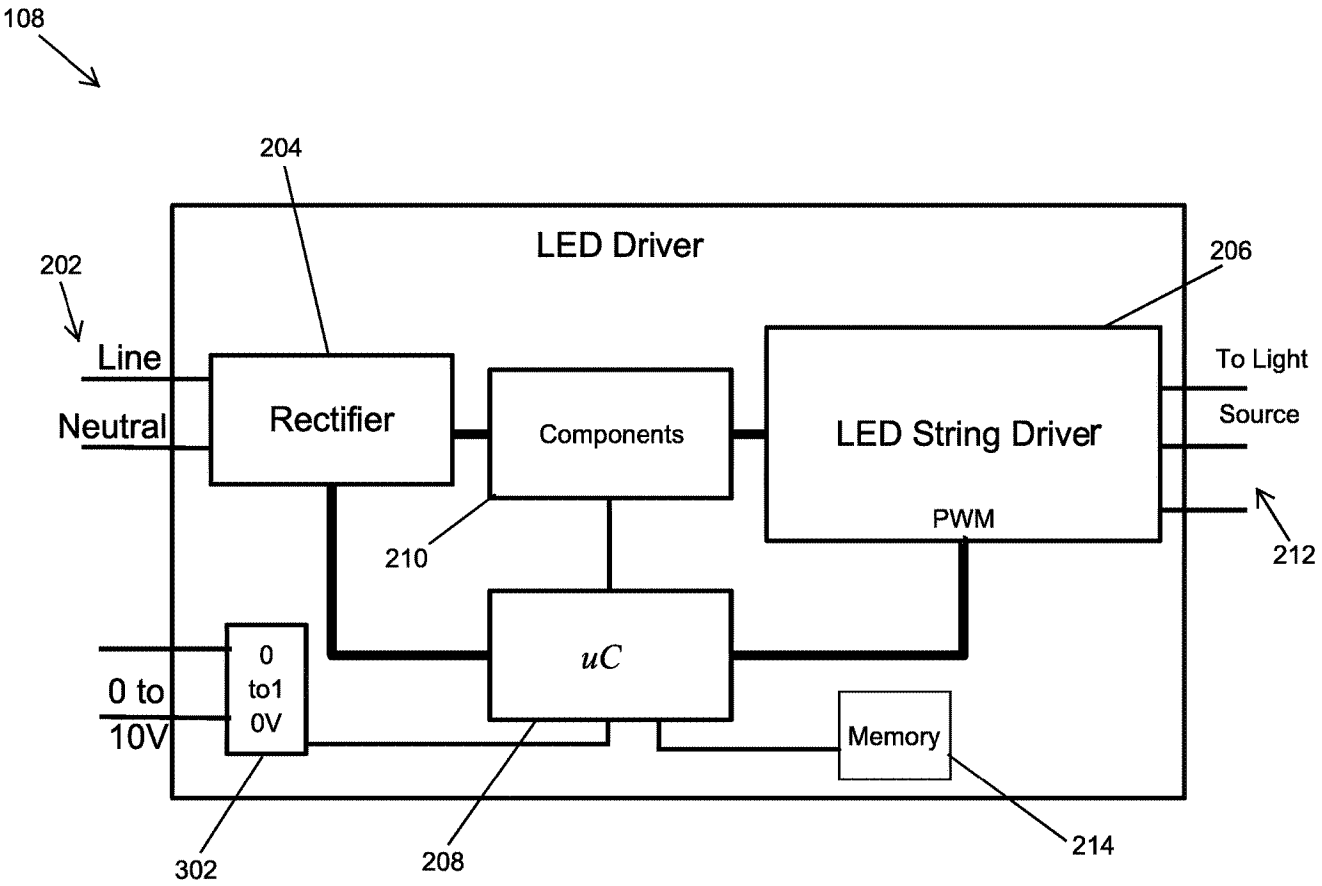
FIG. 3 illustrates the LED driver of FIG. 1 according to another example embodiment.

FIG. 3 illustrates the LED driver 108 of FIG. 1 according to another example embodiment. Referring to FIGS. 1-3, in some example embodiments, the LED driver 108 includes a 0-10V dimmer circuit 302 to adjust the dim level of the light emitted by light source 110 or another light source that may be coupled to the output connection 212 of the driver 108. The 0-10v dimmer circuit 302 may be coupled to, for example, the dimmer 106 that may be a wall-mounted dimmer. The output of the 0-10v dimmer circuit 302 may be provided to the controller 208, and the controller 208 may control the drive circuit 206 based on the output of the dimmer circuit 302 as well as the dim level setting of the driver 208 to control the dim level of the light emitted by the light source 110. For example, the maximum brightness level of the light may be controlled by the dim level setting that can be set/changed based on the toggle sequence of the switch 104, and the particular dim level of the light may be adjusted based on the input of the dimmer 106 that is received by the dimmer circuit 302. Alternatively, the minimum dim level of the light instead of or in addition to the maximum dim level of the light may be set/changed based on the toggle sequence of the switch 104.

In some alternative embodiments, the dimmer circuit 302 may be another type of dimmer without departing from the scope of this disclosure. The output of the 0-10v dimmer circuit 302 may be provided to the drive circuit 206 instead of or in addition to the controller 208. CCT setting as well as the dimmer setting. Alternatively, the output of the 0-10v dimmer circuit 302 may be provided to the drive circuit 206.

Figure 4:
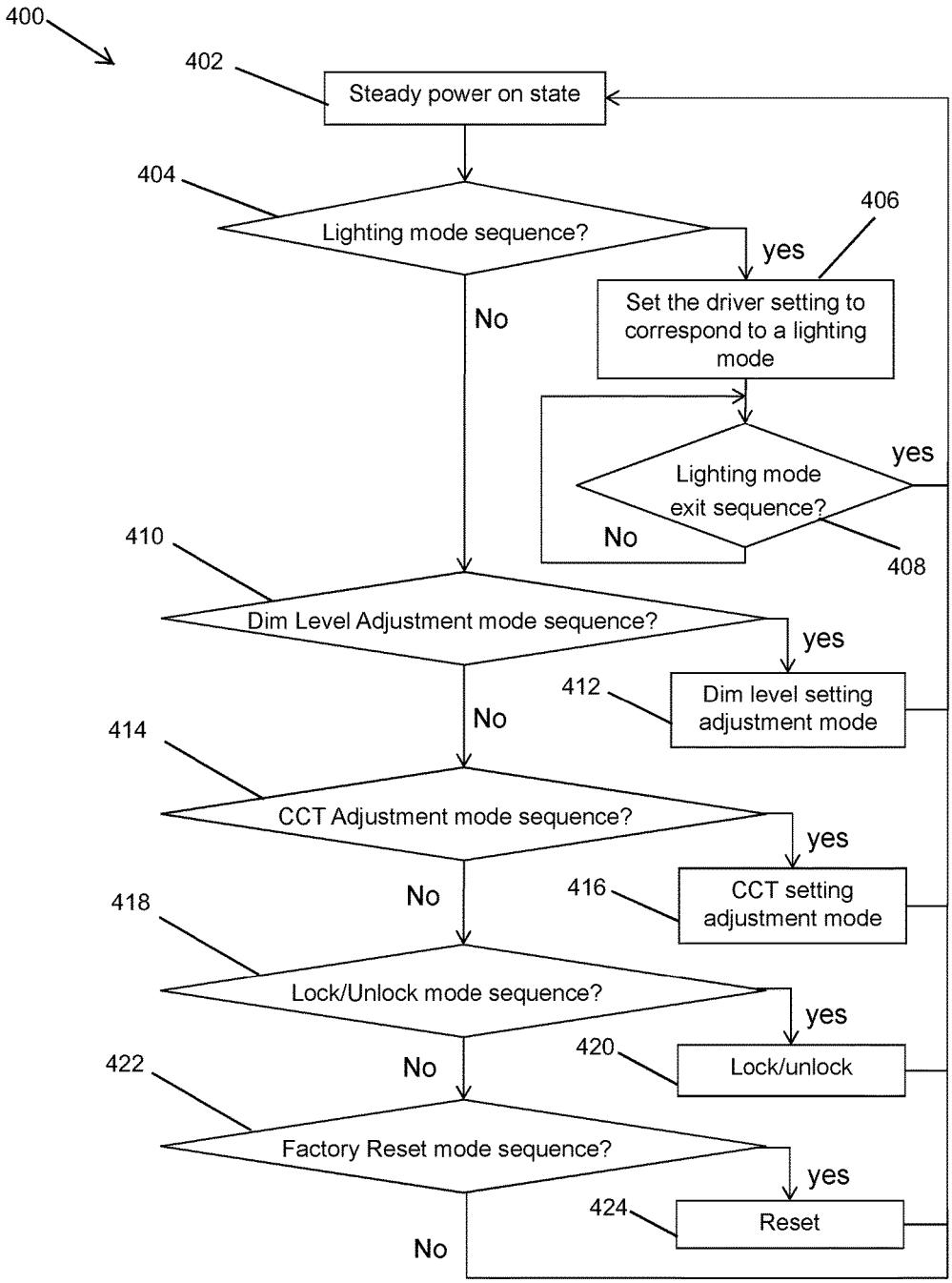
FIG. 4 illustrates a flowchart of a method of controlling a lighting device based on toggles of a switch according to an example embodiment.

FIG. 4 illustrates a flowchart of a method 400 of controlling a lighting device based on toggles of a switch according to an example embodiment. Referring to FIGS. 1-4, in some example embodiments, at 402, the method 400 may start at a steady power on state of the driver 108. The steady power on state may correspond to the state of the driver 108, where the settings of the driver 108 are not being actively updated, for example, based on the toggles of the switch 104. Alternatively, the method 400 may start with a steady power off state. In the steady power on state and at the power up of the driver 108 following the steady power off state, the settings of the driver 108 may have factory default values or may have been previous updated based on the toggles of the switch 104 or by other means.

At 404, the method 400 may include the driver 108 determining whether a toggle sequence of the switch 104 matches a lighting mode sequence. As described above, the driver 108 may detect toggles of the switch 104 and store information related to the toggles in the memory device 214. To illustrate, the driver 108 may determine whether a toggle sequence of the switch 104 matches a night light mode sequence, for example, by comparing the toggle sequence of the switch 104 against the night light mode sequence that may also be stored in the memory device 214. For example, the lighting mode sequence may include the switch 104 being turned off within a first threshold time period (e.g., 2 or 3 seconds) after the switch 104 is turned on, and the switch 104 being turned on and remaining on for a longer time than a second threshold time period (e.g., 2 or 3 seconds) after being turned off within the first threshold time period.

To illustrate, the driver 108 may determine that the toggle sequence of the switch 104 matches the lighting mode sequence if the switch 104 undergoes the following sequence starting from the steady power on state: turned off, turned on, turned off within a first threshold time period (e.g., 3 seconds), and turned back on and remains on for longer than a second threshold time period (e.g., 3 seconds). At 406, if the driver 108 determines that the toggle sequence of the switch 104 matches the lighting mode sequence, the driver 108 may change a setting of the driver 108 (e.g., a dim level setting and/or a CCT setting) to have a particular value that corresponds to the lighting mode corresponding to the lighting mode sequence. In some example embodiments, the driver 108 may operate in the particular lighting mode until one or more toggles of the switch 104 are detected at 408. If one or more toggles are detected, the settings of the driver 108 that were changed may revert to values present prior to the driver 108 operating in the particular lighting mode and start operating in the steady power on state at 402. Alternatively, following changing the setting at 406, the driver 108 may consider the particular lighting mode to be equivalent to the steady power on state.

If the driver 108 determines at 404 that the toggle sequence of the switch 104 does not match the lighting mode sequence, the driver 108 may determine, at 410, whether the toggle sequence checked at 404 and that is based on the same toggles of the switch 104 matches a dim level adjustment mode sequence. Alternatively, at 410, the driver 108 may determine whether a toggle sequence of the switch 104 that is based on one or more subsequent toggles of the switch 104 matches the dim level adjustment mode sequence.

To illustrate, the driver 108 may determine that the toggle sequence of the switch 104 matches the dim level adjustment mode sequence if the switch 104 undergoes the following sequence starting from the steady power on state: turned off, turned on, turned off within a first threshold time period (e.g., 3 seconds), and turned back on and remained on for a shorter time than the second threshold time period (e.g., 3 seconds) (i.e., turned off within the second threshold time period), turned back on and remains on for longer than a third threshold time period (e.g., 2 or 3 seconds). When considered starting from the determination at 404 that the toggle sequence does not match the lighting mode sequence, the subsequent toggles of the switch 104 that result in the toggle sequence matching the dim level adjustment mode sequence may be the switch 104 being turned back on and remaining on for longer than the third threshold time period after being turned off within the second threshold time period. If the toggle sequence compared at 410 matches the dim level adjustment mode sequence, the driver 108 may operate in a dim level setting adjustment mode at 412. The operations of the driver 108 at 412 are described in more detail with respect to FIG. 6. At the end of the dim level setting adjustment mode at 412, the driver 108 may continue operating in the steady power on state.

If the driver 108 determines at 410 that the toggle sequence of the switch 104 does not match the dim level adjustment mode sequence, the driver 108 may determine, at 414, whether the toggle sequence checked at 404 and that is based on the same toggles of the switch 104 matches a CCT adjustment mode sequence. Alternatively, at 414, the driver 108 may determine whether a toggle sequence of the switch 104 that is based on one or more subsequent toggles of the switch 104 matches the CCT adjustment mode sequence.

To illustrate, the driver 108 may determine that the toggle sequence of the switch 104 matches the CCT adjustment mode sequence if the switch 104 undergoes the following sequence starting from the steady power on state at 402: turned off, turned on, turned off within a first threshold time period (e.g., 3 seconds), and turned back on and remained on for a shorter time than the second threshold time period (e.g., 3 seconds) (i.e., turned off within the second threshold time period), turned back on and remains on for a shorter time than a third threshold time period (e.g., 2 or 3 seconds) (i.e., turned off within the third threshold time period), and turned back on and remained on for a longer time than a fourth threshold time period (e.g., 2 or 3 seconds). When considered starting from the determination at 410 that the toggle sequence does not match the dim level adjustment mode sequence, the subsequent toggles of the switch 104 that result in the toggle sequence matching the CCT adjustment mode sequence may be the switch 104 being turned back on and remaining on for longer than the fourth threshold time period after being turned off within the third threshold time period. If the toggle sequence compared at 414 matches the CCT adjustment mode sequence, the driver 108 may operate in a CCT setting adjustment mode at 416. The operations of the driver 108 at 416 are described in more detail with respect to FIG. 7. At the end of the CCT setting adjustment mode at 416, the driver 108 may continue operating in the steady power on state.

If the driver 108 determines at 414 that the toggle sequence of the switch 104 does not match the CCT adjustment mode sequence, the driver 108 may determine, at 418, whether the toggle sequence checked at 404 and that is based on the same toggles of the switch 104 matches a lock/unlock mode sequence. Alternatively, at 418, the driver 108 may determine whether a toggle sequence of the switch 104 that is based on one or more subsequent toggles of the switch 104 matches the lock/unlock mode sequence.

To illustrate, the driver 108 may determine that the toggle sequence of the switch 104 matches the lock/unlock mode sequence if the switch 104 undergoes the following sequence starting from the steady power on state at 402: turned off, turned on, turned off within a first threshold time period (e.g., 3 seconds), and turned back on and remained on for a shorter time than the second threshold time period (e.g., 3 seconds) (i.e., turned off within the second threshold time period), turned back on and remains on for a shorter time than a third threshold time period (e.g., 2 or 3 seconds) (i.e., turned off within the third threshold time period), and turned back on and remained on for a shorter time than the fourth threshold time period (e.g., 2 or 3 seconds) (i.e., turned off within the fourth threshold time period), and turned back on and remains on for a longer time than a fifth threshold time period (e.g., 2 or 3 seconds). If the toggle sequence compared at 418 matches the lock/unlock mode sequence, the setting of the driver 108 may be changed at 420 such that the driver 108 starts operating in the locked or unlocked mode. For example, if the driver 108 was in an unlocked mode, the driver 108 may be start operating in the locked mode where the capability to change one or more of the settings of the driver 108 based on the toggles of the switch 104 becomes disabled. That is, in the locked mode, the operations at one or more of the steps at 406, 412, 416, and 424 as part of the method 400 may be disabled. If the driver 108 was in a locked mode, the driver 108 may be unlocked as the result of the operations at the step 420. At the end of the operations at 420, the driver 108 may continue to operate in the stead power on state at 402.

If the driver 108 determines at 418 that the toggle sequence of the switch 104 does not match the lock/unlock adjustment mode sequence, the driver 108 may determine, at 422, whether the toggle sequence checked at 404 and that is based on the same toggles of the switch 104 matches a factory reset mode sequence. Alternatively, at 420, the driver 108 may determine whether a toggle sequence of the switch 104 that is based on one or more subsequent toggles of the switch 104 matches the factory reset mode sequence.

To illustrate, the driver 108 may determine that the toggle sequence of the switch 104 matches the factory reset mode sequence if the switch 104 undergoes the following sequence starting from the steady power on state at 402: turned off, turned on, turned off within a first threshold time period (e.g., 3 seconds), and turned back on and remained on for a shorter time than the second threshold time period (e.g., 3 seconds) (i.e., turned off within the second threshold time period), turned back on and remains on for a shorter time than a third threshold time period (e.g., 2 or 3 seconds) (i.e., turned off within the third threshold time period), and turned back on and remained on for a shorter time than the fourth threshold time period (e.g., 2 or 3 seconds) (i.e., turned off within the fourth threshold time period), turned back on and remains on for a shorter time than t fifth threshold time period (e.g., 2 or 3 seconds) (i.e., turned off within the fifth threshold time period), and turned back on and remains on for a longer time than a sixth threshold time period (e.g., 2 or 3 seconds). If the toggle sequence compared at 422 matches the factory reset mode sequence, the setting of the driver 108 may be changed at 424 such that the driver 108 performs at least a partial reset to factory default values of settings and other parameters. At the end of the reset that based on the operations at 424, the driver 108 may continue with the steady power on state at 402 based on the settings that resulted from the reset. If the driver 108 determines at 422 that the toggle sequence of the switch 104 does not match the factory reset mode sequence, the driver 108 may continue with the steady power on state at 402 based on the prior settings.

Because the characteristics (e.g., dim level, CCT, etc.) of the light emitted by the light source 110 are controlled based on the settings of the driver 108, changing the settings by using the switch 104 enables lighting adjustment while avoiding the need to replace the switch 104 with a more complex device and the need to replace/add wiring.

Although the operations at 404, 410, 414, 418, and 422 are described as occurring serially, the operations may be performed in parallel. In some alternative embodiments, the driver may not perform the operations at one or more of 404, 410, 414, 418, and 422. In some alternative embodiments, the method 400 may include comparing toggle sequences of the switch 104 to other operation sequences than shown in FIG. 4 and may accordingly change settings of the driver 108 or perform other operations. In some alternative embodiments, other example lighting/operation mode sequences and toggle sequences than described above may be used without departing from the scope of this disclosure. In some alternative embodiments, other orders of the operations at 404, 410, 414, 418, and 422 may be performed without departing from the scope of this disclosure. The driver 108 may also check a toggle sequence at one or more of the steps 404, 410, 414, 418, and 422 for a match against another sequence. For example, the driver 108 may return to the steady power on state or perform another operation based on the comparison.

Figure 5:
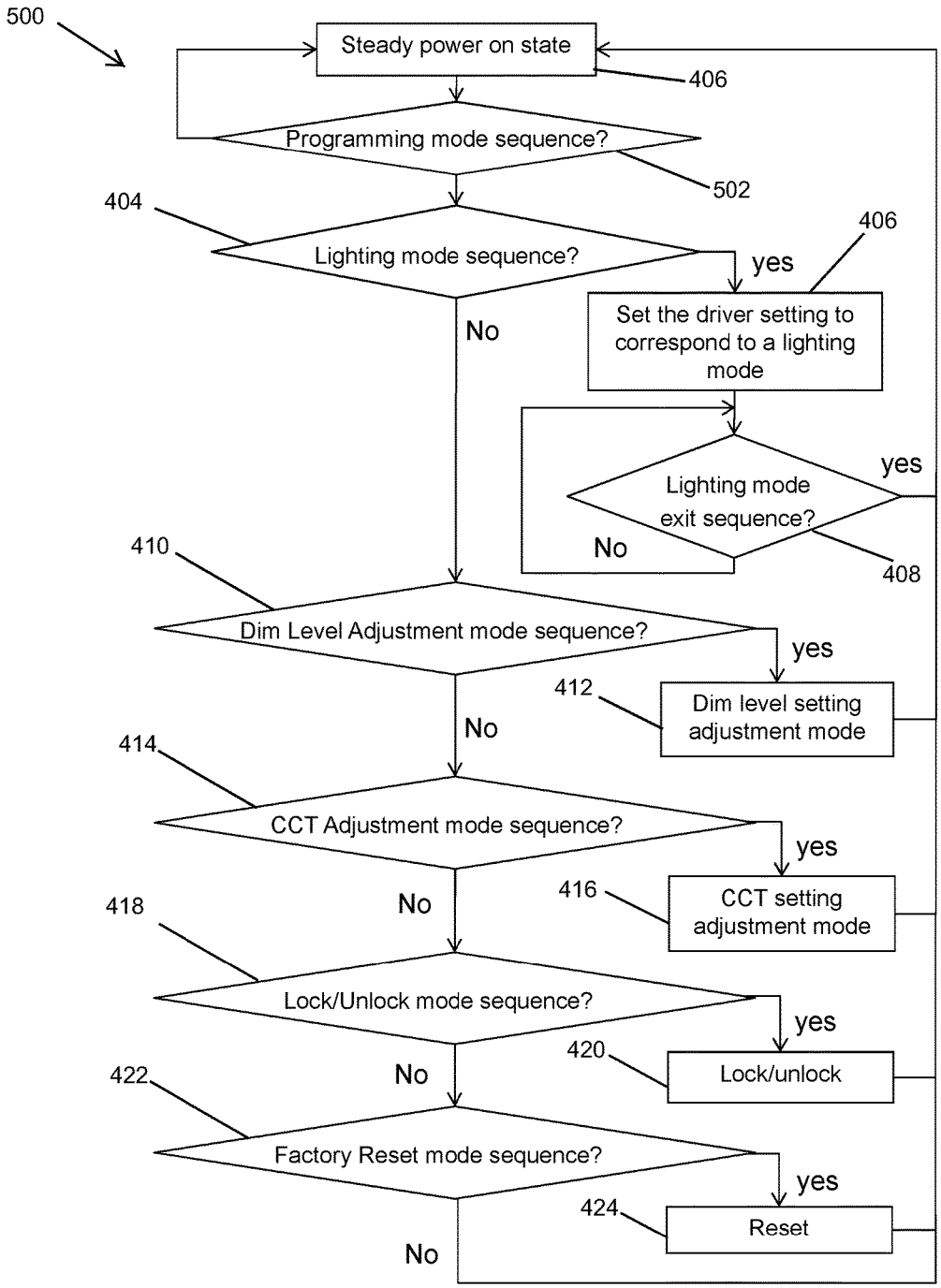
FIG. 5 illustrates a flowchart of a method of controlling a lighting device based on toggles of a switch according to another example embodiment.

FIG. 5 illustrates a flowchart of a method 500 of controlling a lighting device based on toggles of a switch according to another example embodiment. Referring to FIGS. 1-5, the method 500 is substantially the same as the method 400 and may be performed in a similar manner as described above. Focusing on the primary difference, when operating in the steady power on state at 402, the method 500 may include determining, by the driver 108, whether a toggle sequence of the switch 104 matches a programming mode sequence at 502. For example, the driver 108 may perform the operations at 404, 410, 414, 418, and 422 if the toggle sequence of the switch 104 matches the programming sequence. For example, the driver 108 may determine that the toggle sequence of the switch 104 matches the programming sequence if the switch 104 undergoes the following sequence starting from the steady power on state at 402: turned off, turned on, and turned off within a threshold time period (e.g., 3 seconds). Upon the power being restored (i.e., the switch 104 being turned back on), the driver 108 may start in a programming mode, where the driver 108 may perform the operations at the one or more of 404, 410, 414, 418, and 422. The driver 108 may operate based on the toggles of the switch 104 subsequent to the toggles of the switch 104 in the sequence that matches the programming mode sequence. Alternatively or in addition, the driver 108 may consider toggles of the switch 104 starting from the steady power on state at 402 or starting after toggles of the switch 104 considered in a comparison against another operation mode sequence, etc.

Figure 6:
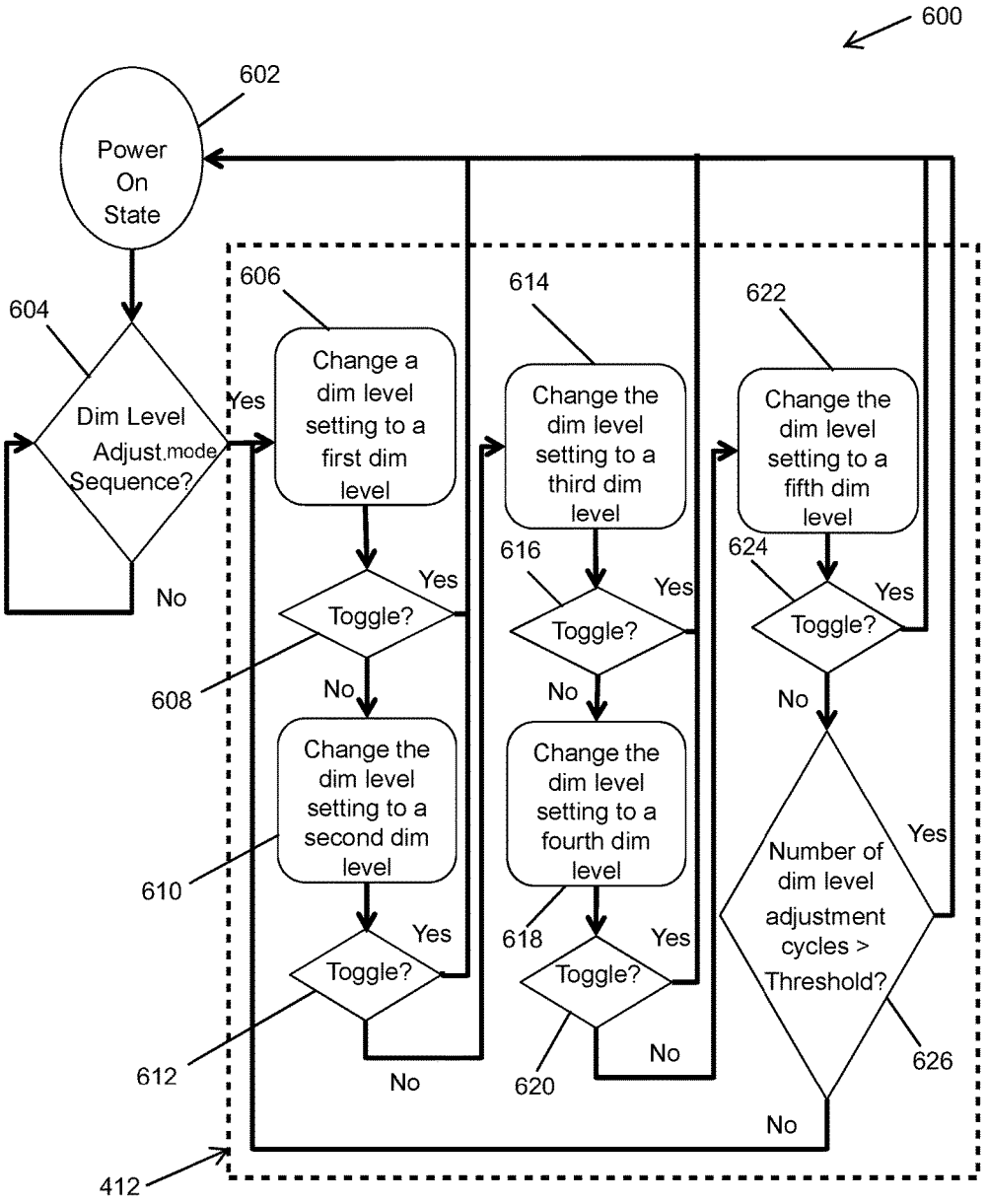
FIG. 6 illustrates a method of adjusting dim level of a light emitted by an LED light source based on toggles of a switch according to an example embodiment.

FIG. 6 illustrates a method 600 of adjusting dim level of a light emitted by an LED light source based on toggles of a switch according to an example embodiment. Referring to FIGS. 1-6, at 602, the method 600 may be a dim level adjustment process that includes the driver 108 being in a steady power on state, such as being in the state power on state at 402 of FIGS. 4 and 5. At step 604, the method 600 includes determining whether the toggle sequence matches the dim level adjustment mode sequence. For example, step 604 may correspond to the step 410 of the methods 400, 500. For example, at step 604, if the driver 108 determines that the toggle sequence matches the dim level adjustment mode sequence as described with respect to the step 410 of the method 400, 500, the remaining operations of the method 600 may correspond to the operations of the method 412 operations following the step 410.

In some example embodiments, at step 606, the method 600 includes changing a dim level setting of the LED driver to a first dim level. For example, the dim level setting of the driver may be saved/stored in the non-volatile memory 214. The first dim level may be one of several discrete dim levels (e.g., stored in the memory device 214) that may be assigned to the dim level setting of the driver 108. As a non-limiting example, the first dim level may be or may correspond to 100% brightness level (i.e., lowest dim level of the light emitted based on the dim level setting).

In some alternative embodiments, the first dim level may be related to the dim level setting existing prior to step 606. For example, the first dim level may be the closest dim level below or above the prior dim level setting from among the different dim levels to which the dim level setting can be changed. Alternatively, the first dim level may be a default or arbitrary dim level to which the dim level setting of the driver is changed upon the driver entering the dim level adjustment process.

At step 608, the method 600 includes checking if one or more toggles of the switch occur within a waiting time period (e.g., 2 or 3 seconds) after changing the dim level setting to the first dim level at step 606. If one or more toggles of the switch are detected by the driver 108 (e.g., the controller 112 of the driver 108) within the waiting time period, the driver 108 may exit the dim level adjustment process/mode and may continue to operate in the steady power on state when the switch 104, if off, is turned on. Alternatively, the driver 108 may operate in a different mode upon exit from the dim level adjustment process.

If the driver does not detect one or more toggles of the switch 104 within the waiting time period after the changing of the dim level setting to the first dim level, the method 600 includes, at step 610, changing the dim level setting of the LED driver 108 to a second dim level, which may be one of the several discrete dim levels that may be assigned to the dim level setting of the driver 108. As a non-limiting example, the second dim level may be or may correspond to 50% of full brightness. During the dim level adjustment process, the driver 108 may check for toggles of the switch 104, for example, as described above. The driver 108 may also monitor time periods, for example, between changes to the dim level setting, and the power-on state of the switch, etc. in a similar manner as described above.

At step 612, the method 600 includes checking if one or more toggles of the switch 104 occur within a waiting time period (e.g., 2 or 3 seconds) after changing the dim level setting to the second dim level at step 610. If one or more toggles of the switch 104 are detected by the driver 108 within the waiting time period, the driver may exit the dim level adjustment process/mode and may continue to operate in the steady power on state when the switch 104, if off, is turned on. Alternatively, the driver 108 may operate in a different mode upon exit from the dim level adjustment process.

If the driver does not detect one or more toggles of the switch within the waiting time period after the changing of the dim level setting to the second dim level, the method 600 includes, at step 614, changing the dim level setting of the LED driver 108 to a third dim level, which may be one of the several discrete dim levels that may be assigned to the dim level setting of the driver 108. As a non-limiting example, the third dim level may be or may correspond to 25% of full brightness.

At step 616, the method 600 includes checking if one or more toggles of the switch occur within a waiting time period (e.g., 2 or 3 seconds) after changing the dim level setting to the third dim level at step 614. If one or more toggles of the switch 104 are detected by the driver 108 within the waiting time period, the driver 108 may exit the dim level adjustment process/mode and may continue to operate in the steady power on state when the switch 104, if off, is turned on. Alternatively, the driver 108 may operate in a different mode upon exit from the dim level adjustment process.

If the driver does not detect one or more toggles of the switch within the waiting time period after the changing of the dim level setting to the third dim level, the method 600 includes, at step 618, changing the dim level setting of the LED driver 108 to a fourth dim level, which may be one of the several discrete dim levels that may be assigned to the dim level setting of the driver 108. As a non-limiting example, the fourth dim level may be or may correspond to 15% of full brightness.

At step 620, the method 600 includes checking if one or more toggles of the switch 104 occur within a waiting time period (e.g., 2 or 3 seconds) after changing the dim level setting to the fourth dim level at step 618. If one or more toggles of the switch are detected by the driver 108 within the waiting time period, the driver 108 may exit the dim level adjustment process/mode and may continue to operate in the steady power on state when the switch 104, if off, is turned on. Alternatively, the driver 108 may operate in a different mode upon exit from the dim level adjustment process.

If the driver 108 does not detect one or more toggles of the switch within the waiting time period after the changing of the dim level setting to the fourth dim level, the method 600 includes, at step 622, changing the dim level setting of the LED driver to a fifth dim level, which may be one of the several discrete dim levels that may be assigned to the dim level setting of the driver. As a non-limiting example, the fifth dim level may be or may correspond to 5% of full brightness.

At step 624, the method 600 includes checking if one or more toggles of the switch 108 occur within a time period (e.g., 2 or 3 seconds) after changing the dim level setting to the fifth dim level at step 622. If one or more toggles of the switch are detected by the driver (e.g., the controller of the driver) within the time period, the driver 108 may exit the dim level adjustment process/mode and may continue to operate in the steady power on state when the switch 104, if off, is turned on. Alternatively, the driver 108 may operate in a different mode upon exit from the dim level adjustment process.

If the driver 108 does not detect one or more toggles of the switch 108 within the waiting time period after the changing of the dim level setting to the fifth dim level, the method 600 includes, at step 626, checking if the number of dim level adjustment cycles exceeds a threshold. For example, the driver 108 may keep track of the number times steps 622 has been performed after without exiting the dim level adjustment process. To illustrate, the driver 108 may exit the dim level adjustment process if the changing of the dim level setting to the fifth dim level is performed, for example, twice or three times since the last start of the dim level adjustment process by the driver 108. If the threshold is not exceeded, the method 600 returns to step 606, where the dim level setting is set to the first dim level.

After each change of the dim level setting during the execution of the method 600, the CCT of the light emitted by the light source 110 may change to reflect the changed dim level setting. Alternatively, the dim level setting adjustments may not be reflected in the light emitted by the light source 110, at step 412, during the dim level setting adjustment process.

Based on the power controlled by the switch 104 and toggles of the switch 104, the driver 108 may enable changing of the dim level setting of the driver 108 and ultimately the dim level of the light emitted by a light source powered/controlled by the driver 108 without requiring a new dimmer, another control device, and new wiring. In some example embodiments, the dim level adjustment process at the step 412 may enable to set the maximum dim level, the minimum dim level, or both such that the brightness level of the light is bound by the maximum, minimum, or both dim levels when the dimmer 106 is present.

Although five dim levels are described above, in alternative embodiments, the method 600 may include more or fewer dim levels. In some alternative embodiments, each change in the dim level setting may be an increment or a decrement from a starting dim level.

Figure 7:
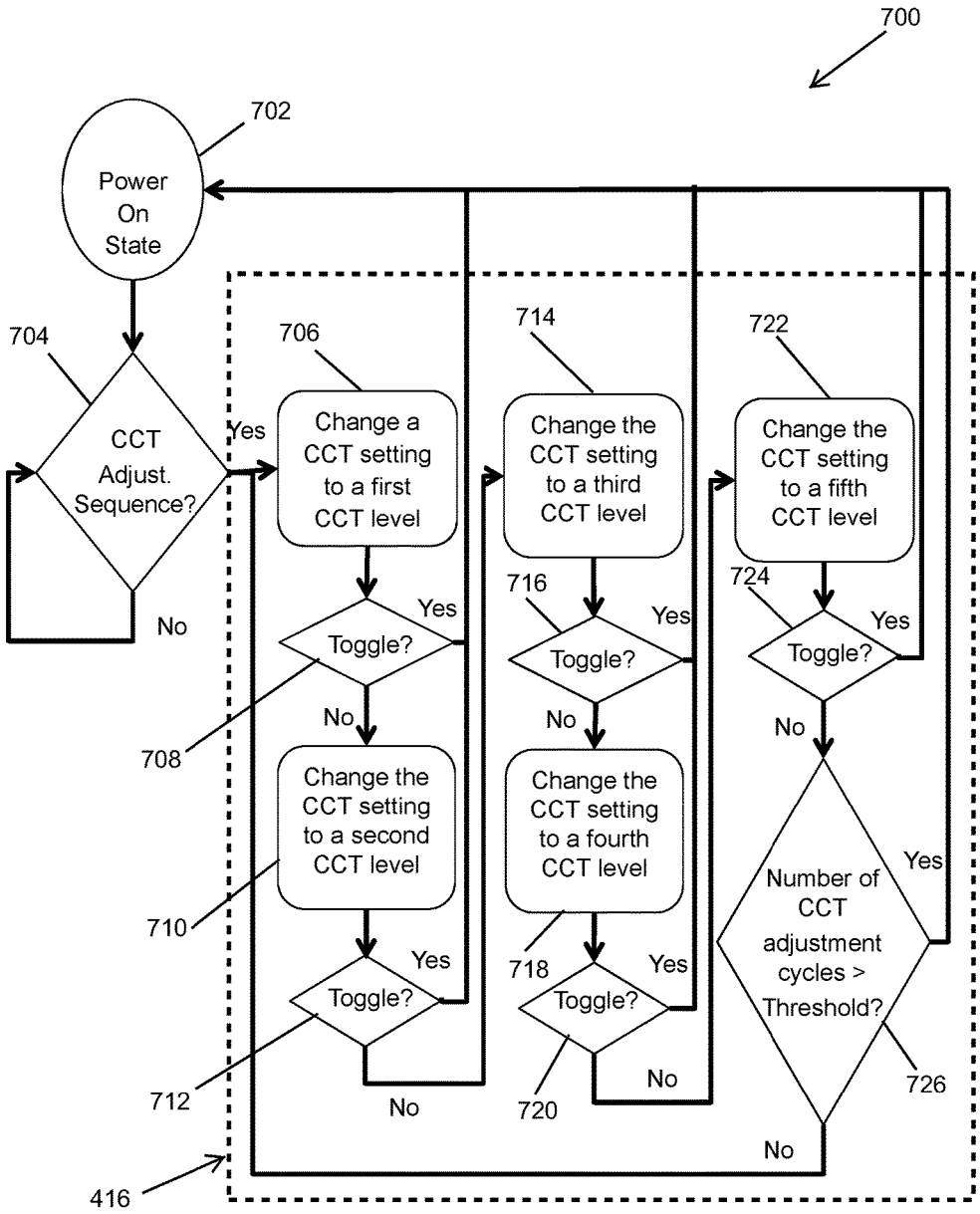
FIG. 7 illustrates a method of adjusting correlated color temperature (CCT) of a light emitted by an LED light source based on toggles of a switch according to an example embodiment.

FIG. 7 illustrates a method 700 of adjusting correlated color temperature (CCT) of a light emitted by an LED light source based on toggles of a switch according to an example embodiment. Referring to FIGS. 1-5 and 7, at 702, the method 700 may be a CCT adjustment process that includes the driver 108 being in a steady power on state, such as being in the state power on state at 402 of FIGS. 4 and 5. At step 704, the method 700 includes determining whether the toggle sequence matches the CCT adjustment mode sequence. For example, step 704 may correspond to the step 414 of the methods 400, 500. For example, at step 704, if the driver 108 determines that the toggle sequence matches the CCT adjustment mode sequence as described with respect to the step 414 of the method 400, 500, the remaining operations of the method 700 may correspond to the operations of the method 416 operations following the step 414.

In some example embodiments, at step 706, the method 700 includes changing a CCT setting of the LED driver to a first CCT level. For example, the CCT setting of the driver may be saved/stored in the non-volatile memory 214. The first CCT level may be one of several discrete CCT levels (e.g., stored in the memory device 214) that may be assigned to the CCT setting of the driver 108. As a non-limiting example, the first CCT level may be or may correspond to 5000K.

In some alternative embodiments, the first CCT level may be related to the CCT setting existing prior to step 706. For example, the first CCT level may be the closest CCT level below or above the prior CCT setting from among the different CCT levels to which the CCT setting can be changed. Alternatively, the first CCT level may be a default or arbitrary CCT level to which the CCT setting of the driver is changed upon the driver entering the CCT level adjustment process.

At step 708, the method 700 includes checking if one or more toggles of the switch occur within a waiting time period (e.g., 2 or 3 seconds) after changing the CCT setting to the first CCT level at step 706. If one or more toggles of the switch are detected by the driver 108 (e.g., the controller 112 of the driver 108) within the waiting time period, the driver 108 may exit the CCT level adjustment process/mode and may continue to operate in the steady power on state when the switch 104, if off, is turned on. Alternatively, the driver 108 may operate in a different mode upon exit from the CCT level adjustment process.

If the driver does not detect one or more toggles of the switch 104 within the waiting time period after the changing of the CCT setting to the first CCT level, the method 700 includes, at step 710, changing the CCT setting of the LED driver 108 to a second CCT level, which may be one of the several discrete CCT levels that may be assigned to the CCT setting of the driver 108. As a non-limiting example, the second CCT level may be or may correspond to 4000K. During the CCT level adjustment process, the driver 108 may check for toggles of the switch 104, for example, as described above. The driver 108 may also monitor time periods, for example, between changes to the CCT setting, and the power-on state of the switch, etc. in a similar manner as described above.

At step 712, the method 700 includes checking if one or more toggles of the switch 104 occur within a waiting time period (e.g., 2 or 3 seconds) after changing the CCT setting to the second CCT level at step 710. If one or more toggles of the switch 104 are detected by the driver 108 within the waiting time period, the driver may exit the CCT level adjustment process/mode and may continue to operate in the steady power on state when the switch 104, if off, is turned on. Alternatively, the driver 108 may operate in a different mode upon exit from the CCT level adjustment process.

If the driver does not detect one or more toggles of the switch within the waiting time period after the changing of the CCT setting to the second CCT level, the method 700 includes, at step 714, changing the CCT setting of the LED driver 108 to a third CCT level, which may be one of the several discrete CCT levels that may be assigned to the CCT setting of the driver 108. As a non-limiting example, the third CCT level may be or may correspond to 3500K.

At step 716, the method 700 includes checking if one or more toggles of the switch occur within a waiting time period (e.g., 2 or 3 seconds) after changing the CCT setting to the third CCT level at step 714. If one or more toggles of the switch 104 are detected by the driver 108 within the waiting time period, the driver 108 may exit the CCT level adjustment process/mode and may continue to operate in the steady power on state when the switch 104, if off, is turned on. Alternatively, the driver 108 may operate in a different mode upon exit from the CCT level adjustment process.

If the driver does not detect one or more toggles of the switch within the waiting time period after the changing of the CCT setting to the third CCT level, the method 700 includes, at step 718, changing the CCT setting of the LED driver 108 to a fourth CCT level, which may be one of the several discrete CCT levels that may be assigned to the CCT setting of the driver 108. As a non-limiting example, the fourth CCT level may be or may correspond to 3000K.

At step 720, the method 700 includes checking if one or more toggles of the switch 104 occur within a waiting time period (e.g., 2 or 3 seconds) after changing the CCT setting to the fourth CCT level at step 718. If one or more toggles of the switch are detected by the driver 108 within the waiting time period, the driver 108 may exit the CCT level adjustment process/mode and may continue to operate in the steady power on state when the switch 104, if off, is turned on. Alternatively, the driver 108 may operate in a different mode upon exit from the CCT level adjustment process.

If the driver 108 does not detect one or more toggles of the switch within the waiting time period after the changing of the CCT setting to the fourth CCT level, the method 700 includes, at step 722, changing the CCT setting of the LED driver to a fifth CCT level, which may be one of the several discrete CCT levels that may be assigned to the CCT setting of the driver. As a non-limiting example, the fifth CCT level may be or may correspond to 2700K.

At step 724, the method 700 includes checking if one or more toggles of the switch 108 occur within a time period (e.g., 2 or 3 seconds) after changing the CCT setting to the fifth CCT level at step 722. If one or more toggles of the switch are detected by the driver (e.g., the controller of the driver) within the time period, the driver 108 may exit the CCT level adjustment process/mode and may continue to operate in the steady power on state when the switch 104, if off, is turned on. Alternatively, the driver 108 may operate in a different mode upon exit from the CCT level adjustment process.

If the driver 108 does not detect one or more toggles of the switch 108 within the waiting time period after the changing of the CCT setting to the fifth CCT level, the method 700 includes, at step 726, checking if the number of CCT level adjustment cycles exceeds a threshold. For example, the driver 108 may keep track of the number times steps 722 has been performed after without exiting the CCT level adjustment process. To illustrate, the driver 108 may exit the CCT level adjustment process if the changing of the CCT setting to the fifth CCT level is performed, for example, twice or three times since the last start of the CCT level adjustment process by the driver 108. If the threshold is not exceeded, the method 700 returns to step 706, where the CCT setting is set to the first CCT level.

After each change of the CCT setting during the execution of the method 700, the CCT of the light emitted by the light source 110 may change to reflect the changed CCT setting. Alternatively, the CCT setting adjustments may not be reflected in the light emitted by the light source 110, at step 416, during the CCT setting adjustment process.

Based on the power controlled by the switch 104 and toggles of the switch 104, the driver 108 may enable changing of the CCT setting of the driver 108 and ultimately the CCT level of the light emitted by a light source powered/controlled by the driver 108 without requiring a CCT control device and new wiring.

Although five CCT levels are described above, in alternative embodiments, the method 700 may include more or fewer CCT levels. In some alternative embodiments, each change in the CCT setting may be an increment or a decrement from a starting CCT level.

Figure 8:
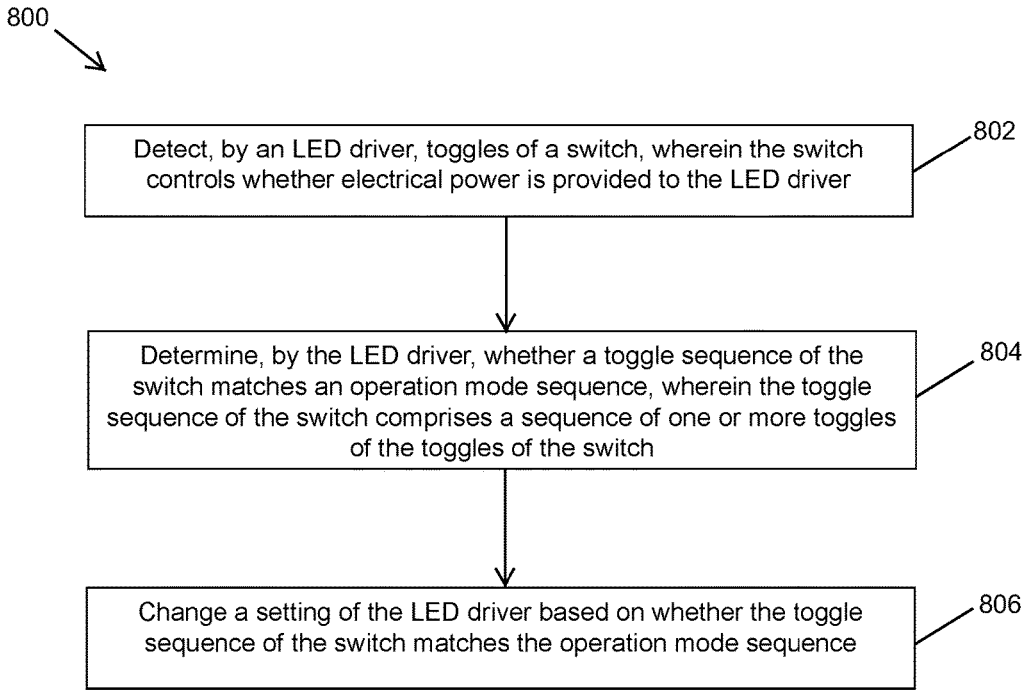
FIG. 8 illustrates a method of controlling a lighting device based on toggles of a switch according to an example embodiment.

FIG. 8 illustrates a method 800 of controlling a lighting device based on toggles of a switch according to an example embodiment. Referring to FIGS. 1-8, in some example embodiments, at step 802, the method 800 includes detecting, by the LED driver 108, toggles of the switch 104, where the switch 104 controls whether electrical power is provided to the LED driver 108 as described above. At step 804, the method 800 may include determining, by the LED driver 108, whether a toggle sequence of the switch 104 matches an operation mode sequence (e.g., a night light mode, dim level adjustment mode, CCT level adjustment mode, lock/unlock mode, factory reset mode, etc.), where the toggle sequence of the switch 104 includes a sequence of one or more toggles of the switch 104. At step 806, the method 800 may include the driver 108 changing a setting of the LED driver based on whether the toggle sequence of the switch 104 matches the operation mode sequence. The driver 108 may determine whether a toggle sequence of the switch 104 matches another sequence and perform operations corresponding to an operation mode sequence if the toggle sequence does not match.

Although a particular order of steps are described above, in alternative embodiments, one or more of the steps or parts of the steps may be performed in a different order without departing from the scope of this disclosure. For example, driver 108 may detect toggles of the switch 104 before and after determining whether a sequence of some of the toggles of the switch 104 matches an operation mode sequence. Further, the method 800 may include other steps than shown without departing from the scope of this disclosure.

Figure 9:
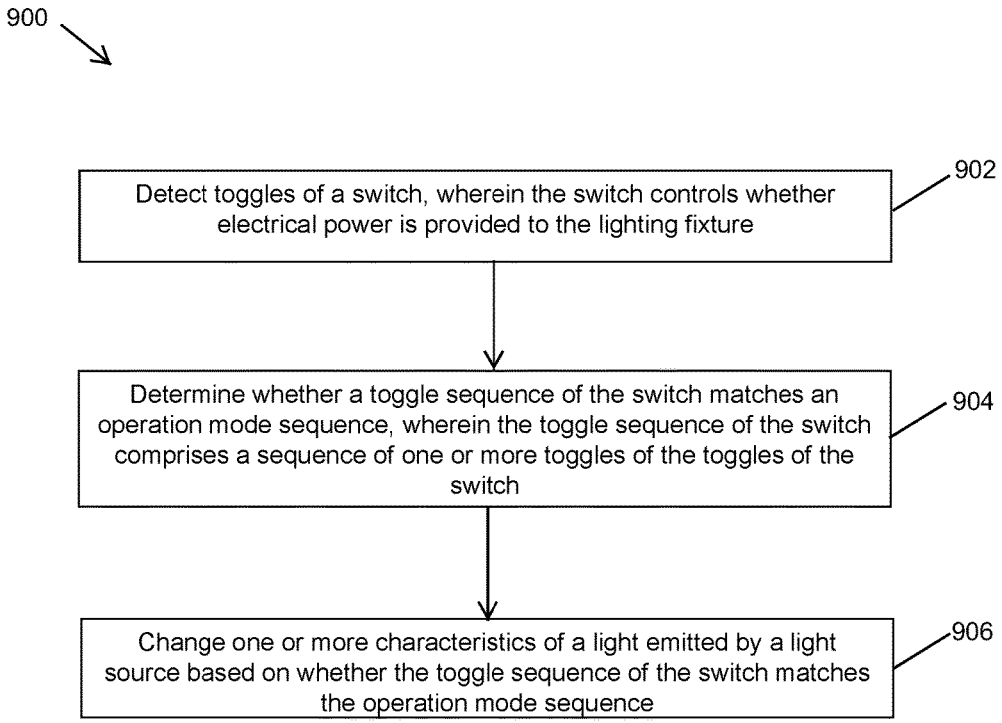
FIG. 9 illustrates a method of controlling a lighting fixture based on toggles of a switch according to an example embodiment.

FIG. 9 illustrates a method 900 of controlling a lighting fixture based on toggles of a switch according to an example embodiment. Referring to FIGS. 1-9, in some example embodiments, at step 902, the method 900 includes detecting, by the LED driver 108, toggles of the switch 104, where the switch 104 controls whether electrical power is provided to the LED driver 108 as described above. At step 904, the method 900 may include determining, by the LED driver 108, whether a toggle sequence of the switch 104 matches an operation mode sequence (e.g., a night light mode, dim level adjustment mode, CCT level adjustment mode, lock/unlock mode, factory reset mode, etc.), where the toggle sequence of the switch 104 includes a sequence of one or more toggles of the switch 104. At step 906, the method 900 may include the driver 108 changing one or more characteristics (e.g., dim level, CCT, etc.) of a light emitted by the light source 110 based on whether the toggle sequence of the switch 104 matches the operation mode sequence. The driver 108 may determine whether a toggle sequence of the switch 104 matches another sequence and perform operations corresponding to an operation mode sequence if the toggle sequence does not match.

Although a particular order of steps are described above, in alternative embodiments, one or more of the steps or parts of the steps may be performed in a different order without departing from the scope of this disclosure. For example, driver 108 may detect toggles of the switch 104 before and after determining whether a sequence of some of the toggles of the switch 104 matches an operation mode sequence. Further, the method 900 may include other steps than shown without departing from the scope of this disclosure.

Although particular examples of toggle sequences of the switch 104 are described above, the toggle sequences of the switch 104 may include other combinations of toggles, different time periods that the switch 104 is in the on-state, etc.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. An LED driver comprising a controller configured to:

detect toggles of a switch that controls whether electrical power is provided to the LED driver;

determine whether a toggle sequence of the switch matches an operation mode sequence, wherein the toggle sequence of the switch comprises a sequence of one or more toggles of the toggles of the switch that the controller detects; and change a setting of the LED driver based on whether the toggle sequence of the switch matches the operation mode sequence.

2. The LED driver of claim 1, wherein the controller is further configured to:

determine whether the toggle sequence of the switch matches a second operation mode sequence; and change the setting of the LED driver based on whether the toggle sequence of the switch matches the second operation mode sequence.

3. The LED driver of claim 1, wherein the controller is further configured to:

determine whether a second toggle sequence of the switch matches a second operation mode sequence in response to detection of one or more toggles of the switch; and change the setting of the LED driver based on whether the second toggle sequence of the switch matches the second operation mode sequence.

4. The LED driver of claim 1, further comprising a non-volatile memory device, wherein the controller stores information related to the toggle sequence of the switch in the memory device during a time period that the switch is turned on.

5. The LED driver of claim 1, wherein the setting of the LED driver includes a dim level setting of the driver and wherein the LED driver changes the dim level setting of the driver based on whether the toggle sequence of the switch matches the operation mode sequence.

6. The LED driver of claim 1, wherein the setting of the LED driver includes a correlated color temperature (CCT) setting of the driver and wherein the LED driver changes the CCT setting of the driver based on whether the toggle sequence of the switch matches the operation mode sequence.

7. The LED driver of claim 1, wherein changing the setting of the LED driver changes whether one or more settings of the driver are adjustable based on one or more toggle sequences of the switch.

8. The LED driver of claim 1, wherein changing the setting of the LED driver results in the driver being at least partially reset to a factory default state.

9. A lighting fixture, comprising:

a light emitting diode (LED) light source; and a driver that provides power to the LED light source, the driver configured to:

detect toggles of a switch that controls whether electrical power is provided to the light fixture;

determine whether a toggle sequence of the switch matches an operation mode sequence of the lighting fixture, wherein the toggle sequence of the switch comprises a sequence of one or more toggles of the toggles of the switch that the driver detects; and change one or more characteristics of a light emitted by the LED light source based on whether the toggle sequence of the switch matches the operation mode sequence.

10. The lighting fixture of claim 9, wherein the driver is further configured to:

determine whether the toggle sequence of the switch matches a second operation mode sequence; and change the one or more characteristics of the light based on whether the toggle sequence of the switch matches the second operation mode sequence.

11. The lighting fixture of claim 9, wherein the driver is further configured to:

determine whether a second toggle sequence of the switch matches a second operation mode sequence in response to detection of one or more toggles of the switch; and change the one or more characteristics of the light based on whether the second toggle sequence of the switch matches the second operation mode sequence.

12. The lighting fixture of claim 9, further comprising a non-volatile memory device, wherein the controller stores information related to the toggle sequence of the switch in the memory device during a time period that the switch is turned on.

13. The lighting fixture of claim 9, wherein the one or more characteristics of the light includes a dim level of the light and wherein the LED driver changes the dim level of the light based on whether the toggle sequence of the switch matches the operation mode sequence.

14. The lighting fixture of claim 9, wherein the one or more characteristics of the light includes a correlated color temperature (CCT) of the driver and wherein the LED driver changes the CCT of the light based on whether the toggle sequence of the switch matches the operation mode sequence.

15. The lighting fixture of claim 9, wherein the driver is further configured to change whether one or more settings of the driver are adjustable based on one or more toggle sequences of the switch.

16. A method of controlling operations of a lighting device, the method comprising:

detecting, by an LED driver, toggles of a switch, wherein the switch controls whether electrical power is provided to the LED driver;

determining, by the LED driver, whether a toggle sequence of the switch matches an operation mode sequence, wherein the toggle sequence of the switch comprises a sequence of one or more toggles of the toggles of the switch that the LED driver detects; and changing a setting of the LED driver based on whether the toggle sequence of the switch matches the operation mode sequence.

17. The method of claim 16, further comprising storing information related to the toggle sequence in a non-volatile memory during a time period that the switch is on.

18. The method of claim 16, further comprising:

determining whether the toggle sequence of the switch matches a second operation mode sequence; and changing the setting of the LED driver based on whether the toggle sequence of the switch matches the second operation mode sequence.

19. The method of claim 18, wherein the operation mode sequence includes:

the switch being turned off within a threshold time period after the switch is turned on; and the switch being turned on and remaining on for a longer time than a second threshold time period after being turned off within the threshold time period.

20. The method of claim 19, wherein the second operation mode sequence includes:

the switch being turned on and remaining on for a shorter time than the second threshold time period after being turned off within the first threshold time period; and the switch being turned on and remaining on a longer time than a third threshold time period after being turned off within the second threshold time period.

21. The method of claim 16, further comprising:

determining whether a second toggle sequence of the switch matches a second operation mode sequence in response to detecting one or more toggles of the switch; and changing the setting of the LED driver based on whether the second toggle sequence of the switch matches the second operation mode sequence.

22. The method of claim 21, wherein the second operation mode sequence includes:

after the switch is turned off within a first threshold time period, the switch being turned on and remaining on for a shorter time than a second threshold time period; and the switch being turned on and remaining on a longer time than a third threshold time period after being turned off within the second threshold time period.

23. The method of claim 16, wherein the setting of the driver includes a dim level setting of the driver and wherein the driver is configured to control a light source to emit a light having a predetermined dim level during a low lighting mode of the lighting device.

24. The method of claim 16, wherein the step of changing the setting of the LED driver is performed during a dim level adjustment process, wherein the driver performs the dim level adjustment process by changing the dim level setting of the driver to a number of dim levels, and wherein the driver waits a waiting period after changing of the dim level setting to one of the number of dim levels before performing a next change of the dim level setting.

25. The method of claim 16, wherein the step of changing the setting of the LED driver is performed during a correlated color temperature (CCT) adjustment process, wherein the driver performs the CCT adjustment process by changing the CCT setting of the driver to a number of CCT levels, and wherein the driver waits a waiting period after changing of the CCT setting to one of the number of CCT levels before performing a next change of the CCT setting.

26. The method of claim 16, wherein the step of changing the setting of the LED driver changes whether one or more settings of the driver are adjustable based on one or more toggle sequences of the switch.

27. The method of claim 16, wherein the step of changing the setting of the LED driver results in the driver being reset to a factory default state.

* * * * *